US005843614A

United States Patent [19]

Shinzo et al.

[11] Patent Number: 5,843,614

[45] Date of Patent: Dec. 1, 1998

[54] MANUFACTURING METHOD FOR TONER USED IN ELECTROPHOTOGRAPHY

[75] Inventors: Kinji Shinzo, Sakura; Hideki Watanabe, Yotsukaido; Seiichi Uno, Sakura; Munekazu Hayashi, Ichihara, all of Japan

[73] Assignee: Dainippon Ink and Chemicals, Inc., Tokyo, Japan

[21] Appl. No.: 821,054

[22] Filed: Mar. 20, 1997

[30] Foreign Application Priority Data

Mar. 21, 1996 [JP] Japan ..... 8-064930
Mar. 17, 1997 [JP] Japan ..... 9-062903

[51] Int. Cl.[6] ..... G03G 9/09
[52] U.S. Cl. ..... 430/137
[58] Field of Search ..... 430/106, 137, 430/110

[56] References Cited

U.S. PATENT DOCUMENTS

| | | | |
|---|---|---|---|
| 3,910,846 | 10/1975 | Azar et al. | 252/62.1 |
| 5,622,806 | 4/1997 | Veregin et al. | 430/137 |
| 5,665,506 | 9/1997 | Kashima et al. | 430/137 |

FOREIGN PATENT DOCUMENTS

| | | |
|---|---|---|
| 0 280 789 | 9/1988 | European Pat. Off. . |
| 0 302 939 | 2/1989 | European Pat. Off. . |
| 56-154739 | 11/1981 | Japan . |
| 07228783 | 8/1995 | Japan . |
| 2 133 571 | 7/1984 | United Kingdom . |
| WO 93/16415 | 8/1993 | WIPO . |

OTHER PUBLICATIONS

Derwent Publications; JP 06 332 225 A(Dainipon), Dec. 2, 1994.

European Search Report for European Application 97104875.6 dated Jul. 21, 1997,

*Primary Examiner*—John Goodrow
*Attorney, Agent, or Firm*—Armstrong, Westerman, Hattori, McLeland & Naughton

[57] ABSTRACT

A novel manufacturing method for toner used in electrophotography employing no organic solvent is disclosed. The method comprises the steps of: (1) combing a colored melted resin (a) and an aqueous medium (b), wherein the colored melted resin (a) is prepared by heating and melting a kneaded material containing a synthetic resin for use in an electrophotographic toner having an ionic group and a coloring pigment, and the aqueous medium (b) contains a substance capable of neutralizing the ionic group, and possesses a raised temperature not lower than the softening point of the synthetic resin by way of heating with application of pressure where necessary; (2) dispersing the colored melted resin (a) in the aqueous medium (b) by mechanical means while maintaining a mixture of the colored melted resin (a) and the aqueous medium (b) at a temperature not lower than the softening point of the synthetic resin; (3) producing an aqueous suspension of colored resin microparticles by means of sudden cooling; (4) separating the colored resin microparticles from the suspension; and (5) drying the separated colored resin microparticles.

9 Claims, 3 Drawing Sheets

MANUFACTURING METHOD FOR TONER USED IN ELECTROPHOTOGRAPHY

BACKGROUND OF THE INVENTION

1. Field of the Invention

The present invention relates to a manufacturing method for toner used in electrophotography, which is employed in the technical fields of electrophotography, electrostatic recording, electrostatic printing, and the like.

2. Description of Related Art

Conventionally, resin particles produced by the so called pulverization method, in which a resin, or a compound consisting of resin and a pigment melted and kneaded together, was pulverized using a pulverizer such as a jet mill or the like, were widely used industrially as resin particles for toner, powder coating, and the like.

However, in recent years, resin particles other than those produced by the pulverization method have come to be known, such as resin particles produced by the so called suspension polymerization method, in which suspension polymerization is conducted by suspending and dispersing in an aqueous medium a vinyl monomer, or dispersion in which a pigment is dispersed in a vinyl monomer; resin particles produced by a dispersion polymerization method, in which a monomer is dissolved in an organic solvent, polymerization proceeds, and resin particles are precipitated; and resin particles resulting from the aggregation and granulation of microparticles produced by emulsification polymerization; these are all beginning to find applications as toners.

A list of the problems encountered when employing these conventionally produced resin particles as toners is given below.

1) The toners manufactured by means of the so called pulverization. method inevitably have shapes which are irregular, and in particular, there is a problem in that in the case of so called small particle diameter toner having a volume average diameter of 8 mm or less, the fluidity as a powder becomes extremely poor.

A second problem encountered with the toner of the pulverization method is that as the diameter of the particles becomes smaller, the pulverizing energy consumption required per weight of the toner rapidly increases, and the costs become very high. The trend in recent electrophotographic technology is that the average particle diameter of the toner has become smaller and smaller as a result of the requirements from the point of view of resolution, gradation, and picture quality, and in the near future, the development of ultra microgranular toner of 5 mm or less is expected; however, it is extremely difficult to overcome this second problem using toner produced by the conventional pulverization method.

Furthermore, it has recently been the case that a number of problems from the point of view of safety and sanitation relating to toners have been pointed out. The monomers remaining in the toner, and in particular, the styrene monomers remaining in styrene acrylate toners, have caused great concern, and consideration has been given to the reduction of the residual amount thereof in the resin synthesis steps.

The problem of how to reduce the remaining aromatic carboxylic acids, such as terephthalate monomers and the like, even in polyester system toners has been recognized as a future theme.

2) In the suspension polymerization method, a radical polymerization initiator is added to an oil phase in which a pigment or the like is dispersed in vinyl monomers, this is suspended in water, and a polymerization reaction is caused to occur, and spherical toner suspension polymer resin particles are obtained; however, as is evident in this case, the main component of the resin is limited to vinyl polymers which are capable of radical polymerization. Resin particles comprising 100% polyester cannot be produced by the suspension polymerization method. A method is also possible in which polyester resin is dissolved in vinyl monomers and suspension polymerization is conducted; however, it is difficult to dissolve a large amount of polyester resin in vinyl monomers, and it is difficult to produce resin particles containing 50% or more polyester resin in the total resin using the suspension polymerization method.

Another problem with suspension polymerization method is that the amount of toner suspension polymer obtained per batch is low. This is because a greatly excessive amount of water, in a water/monomer ratio of more than 80/20, is required in order to ensure stable stirring possible without the toner-sized suspension particles cohering and forming blocks at the reaction temperature between 60°–95° C. during the radical polymerization reaction takes place, which normally requires approximately 10 hours. Furthermore, in the suspension polymerization method, it is necessary to employ a large amount of suspension stabilizer (approximately 1% or more), and if this remains on the surface after the completion of the reaction, the electrostatic charge characteristics of the toner are adversely affected, so that extremely difficult washing and removal operations are required, and the cost of production of the toner increases.

3) Problems similar to those of the suspension polymerization method described above are also present with resin particles resulting from the dispersion polymerization or from the aggregation and granulation of microparticles formed by emulsification polymerization.

4) The present applicants have proposed a spherical toner and a manufacturing method therefor which do not involve a suspension stabilizer or an emulsifier, in which a self-emulsifing resin is subjected to a phase inversion emulsification method (Japanese Patent Application, First publication, No. Hei 5-66600). This technique involves batch processing, and provides toner particles having a sharp particle size distribution by means of normal stirring; because normal phase inversion emulsification, that is to say, phase inversion emulsification employing a solvent, is employed, a process for the removal and recovery of the solvent after phase inversion emulsification, or a process for the recovery of emulsification loss produced during phase inversion, are necessary, and the process as a whole is complicated. (Hereinbelow, the phase inversion emulsification method of Japanese Patent Application, First publication No. Hei 5-66600 will be referred to as the 'solvent method')

SUMMARY OF THE INVENTION

The present invention provides a novel manufacturing method for toners used in electrophotography which solves the problems present in the conventional technology described above.

The present invention radically improves the solvent method, and solves the problems present therein.

Concretely:

1) The present invention is a manufacturing method for a synthetic resin aqueous dispersion having polyester as a chief component which employes a novel manufacturing method principle in which an organic solvent is not employed (hereinbelow referred to as a non-solvent emulsification method). This synthetic resin can be employed as a novel polyester system spherical toner employing the electrostatic charge image development which is used, in particular, in electrophotography.

2) The present invention provides a continuous manufacturing method which is simple and has high productivity, and which requires no process for the removal and recovery of an organic solvent such as that in the solvent method.

3) The present invention provides a novel manufacturing method involving almost no emulsification loss such as that in the solvent method, and which accordingly does not require a process for the recovery of emulsification loss from the waste water.

4) The present invention provides a novel manufacturing method which does not necessitate the use of dispersion stabilizers and surfactants, the use of which was necessary in the methods described above, such as the suspension polymerization method and the dispersion polymerization method.

5) The present invention provides a spherical toner having little of the polyester acid component monomers remaining in the toner.

The present inventors have conducted repeated consideration and experimentation directed towards the achievement of emulsification without using an organic solvent and in which the oil phase represented only the melted resin itself; as a result, they have arrived at the present invention.

That is to say, the present invention:

(1) Provides a manufacturing method for toner used in electrophotography consisting of the following steps: (1) combing a colored melted resin (a) and an aqueous medium (b), wherein the colored melted resin (a) is prepared by heating and melting a kneaded material containing a synthetic resin for use in an electrophotographic toner having an ionic group and a coloring pigment, and the aqueous medium (b) contains a substance capable of neutralizing the ionic group, and possesses a raised temperature not lower than the softening point of the synthetic resin by way of heating with application of pressure where necessary; (2) dispersing the colored melted resin (a) in the aqueous medium (b) by mechanical means while maintaining a mixture of the colored melted resin (a) and the aqueous medium (b) at a temperature not lower than the softening point of the synthetic resin; (3) producing an aqueous suspension of colored resin microparticles by means of sudden cooling; (4) separating the colored resin microparticles from the suspension; and (5) drying the separated colored resin microparticles, wherein:

it is preferable that the synthetic resin for the electrophotographic toner containing an ionic group possess the ionic group in an amount within a range of 1–50 mg equivalents per 100 g of the resin, it is preferable that this synthetic resin be a polyester resin and/or a vinyl co-polymer, the softening point of the resin be within a range of 70°–150° C., and it is preferable that the synthetic resin for the electrophotographic toner having an ionic group contain at leaset 50 percent by weight of polyester resin; and In the manufacturing method for electrophotographic toner, mechanical fine dispersion is conducted using a high speed rotating type continuous emulsification disperser which is provided with a ring shaped stator having slits, and a ring shaped rotator having slits, which are arranged coaxially with a slight gap therebetween so that the stator and the rotator engage with one another.

In accordance with the present invention, it is possible to produce a toner having a small particle diameter by means of an extremely simple and highly productive continuous manufacturing method without using an organic solvent, a dispersion stabilizer, or a surfactant. In particular, with toners having polyester resin as the chief component thereof, it is possible to produce such toners with a reduced amount of residual acid component monomers in the toner.

Furthermore, in accordance with the manufacturing method for colored resin particles of the present invention, even those resins which could not be pulverized by conventional pulverizing processes can be economically "pulverized".

DESCRIPTION OF THE PREFERRED EMBODIMENTS

Figure 1A:
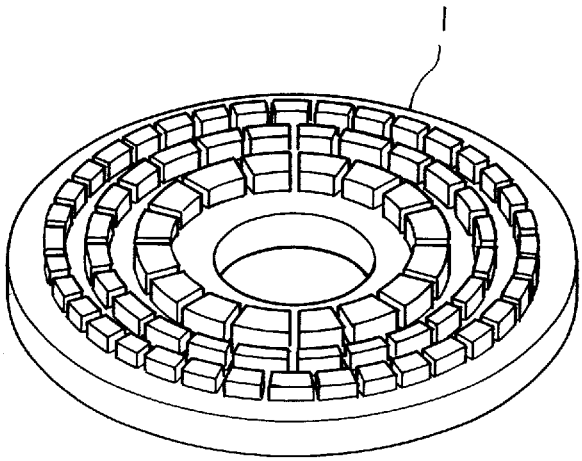
FIG. 1A is a perspective view of the stator of the rotating type continuous emulsification disperser used in the present invention.
Figure 1B:
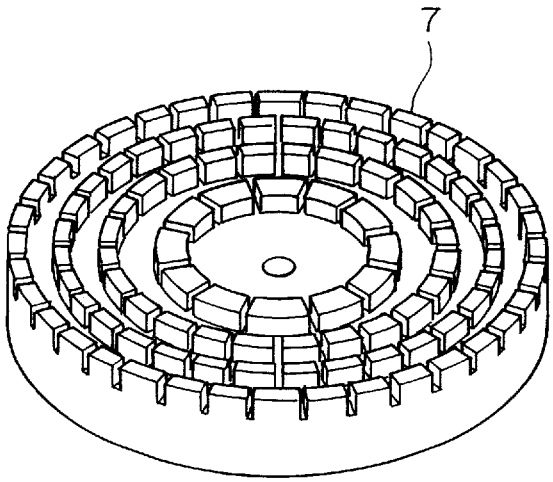
FIG. 1B is a perspective view of the rotator of the rotating type continuous emulsification disperser used in the present invention.
Figure 2:
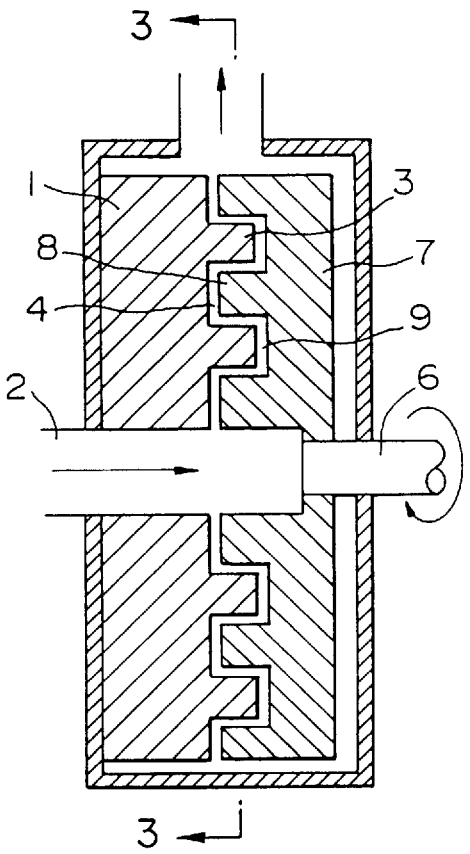
FIG. 2 shows a cross sectional view of the main parts of the rotating type continuous emulsification disperser used in the present invention.
Figure 3:
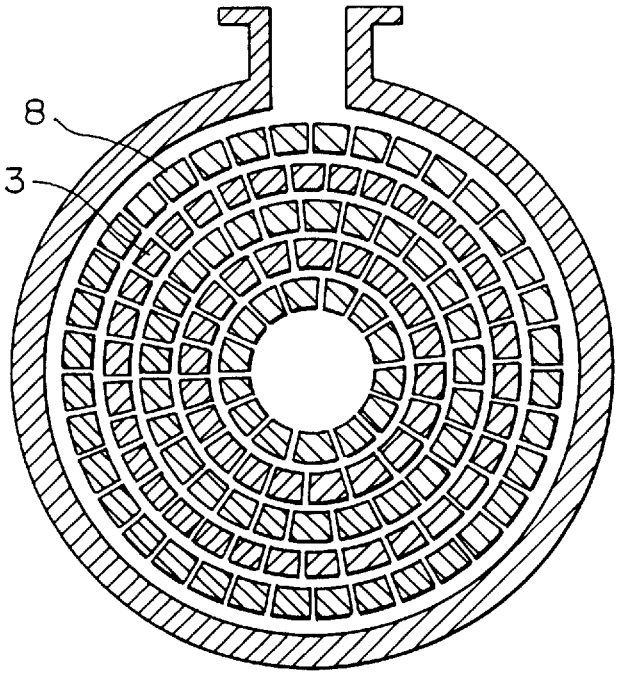
FIG. 3 shows the engaged state of the stator projections and the rotator projections when viewed from the side along the line A–A' in FIG. 2.

The present invention is a method (the non-solvent emulsification method) for manufacturing a toner for use in electrophotography by means of dispersing colored resin microparticles in an aqueous medium without using a solvent, and separating and drying colored resin particles from this emulsification dispersion; it encompasses the following 5 processes.

First, the first process of the present invention will be explained.

In this process, a colored melted resin (a) formed by the heating and melting of a kneaded material containing a synthetic resin for electrophotographic toners having an ionic group, and a colored pigment, and an aqueous medium (b) containing a substance which neutralizes the ionic group, and which is heated to a temperature at or above the softening point of the synthetic resin by heating, and where necessary, by further pressurizing, are prepared.

The synthetic resin for use in electrophotographic toner having an ionic group which is employed in this process may be any sort of resin, insofar as an ionic group is contained in the molecule, and it is applicable to electrophotographic toners. The ionic group should preferably be present in an amount within a range of 1–50 mg equivalents per 100 g of resin, from the point of view of the dispersion stability of the synthetic resin in the synthetic resin aqueous dispersion. An amount within a range of 2–30 mg equivalents per 100 g of resin is further preferable, and an amount within a range of 5–30 mg equivalents per 100 g is even more preferable.

What is meant by an ionic group is a functional group within the resin which can be made by neutralization into an ion radical which is hydrophilic and contributes to the ability to be dispersed in water. For example, when an anionic group (acid radical) is neutralized by a basic substance such as NaOH, ammonia, or the like, this becomes an ion radical (anion) which contributes to the ability to be dispersed in water, while when a cationic group is neutralized by an acid substance such as hydrochloric acid or the like, this becomes an ion radical (cation) which contributes to the ability to be dispersed in water.

Examples of ionic groups include anionic groups (acid radicals) such as carboxyl groups, sulfonic acid groups, phosphoric acid groups, and the like, and cationic groups such as diethyl amine groups, pyridine, and like.

Examples of synthetic resins for use in electrophotographic toners having ionic groups include polyester resins, vinyl copolymers, polyurethane resins, and epoxy resins having such ionic groups. Among these, polyester resin and/or vinyl copolymers are preferably employed.

In the case in which the toner for use in electrophotography of the present invention is employed as a color toner which is used in color copiers and color printers, the use of a mixture of 100% polyester resin, or a resin in which the polyester component is 50 weight percent or more of the total resin, with another resin, or a graft co-polymer or block co-polymer with another resin, is preferable. When the polyester component is 50 weight percent or more of the total resin, then the dispersion of the color pigment is satisfactory, and the coloring is good.

Examples of synthetic resins having anionic group include vinyl copolymers having aninoic group obtained by copolymerization of polymerizable monomers containing anionic group and other polymerizable monomers containing no ionic group.

Examples of such polymerizable monomers containing anionic groups include: acrylic acid, methacrylic acid, crotonic acid, itaconic acid, maleic acid, fumaric acid, monobutyl itaconate, monobutyl maleate, acid phosphooxy ethyl methacrylate, acid phosphooxy propyl methacrylate, 3-chloro-2-acrylamido-2-methyl propane sulfonate, 2-sulfoethylmethacrylate, and the like.

Examples of other polymerizable monomers containing no ionic groups include: various styrene monomers (aromatic vinyl monomers) such as styrene, vinyl toluene, 2-methylstyrene, t-butyl styrene, and chlorostyrene; various acrylic esters such as methyl acrylate, ethyl acrylate, isopropyl acrylate, n-butyl acrylate, isobutyl acrylate, n-amyl acrylate, isoamyl acrylate, n-hexyl acrylate, 2-ethylhexyl acrylate, n-octyl acrylate, decyl acrylate, and dodecyl acrylate; various methacrylate esters such as methyl methacrylate, propyl methacrylate, n-butyl methacrylate, isobutyl methacrylate, n-amyl methacrylate, n-hexyl methacrylate, 2-ethylhexyl methacrylate, n-octyl methacrylate, decyl methacrylate, and dodecyl methacrylate; various monomers containing hydroxyl group such as hydroxyethyl acrylate and hydroxypropyl methacrylate; or various N-substituted (meth) acrylic monomers such as N-methylol (meth) acrylamide or N-butoxymethyl (meth) acrylamide; and the like. It is also possible to use monomers having a small amount of vinyl monomers having 3 functional groups which are copolymerized.

Other examples of the synthetic resin used in electrophotographic toner having an anionic group which is used in the present invention include polyester resins synthesized by the dehydrating condensation of a polybasic acid and polyhydric alcohol. Examples of the polybasic acid include: aromatic carboxylic acids such as terephthalic acid, isophthalic acid, phthalic anhydride, trimellitic anhydride, pyromellitic acid, naphthalenedicarboxylic acid, and the like; aliphatic carboxylic acids such as maleic anhydride, fumaric acid, succinic acid, alkenyl succinic anhydride, adipic acid, and the like; and alicyclic carboxylic acids such as cyclohexane dicarboxylic acid and the like. It is possible to use 1 or 2 or more of these polybasic acids. Furthermore, among these polybasic acids, aromatic carboxylic acids are preferable, and among these, terephthalic acid is further preferable.

Examples of the polyhydric alcohol include: aliphatic diols such as ethylene glycol, propylene glycol, butane diol, hexane diol, neopentyl glycol, glycerine, and the like; alicyclic diols such as cyclohexane diol, cyclohexane dimethanol, hydrogenated Bisphenol A, and the like; and aromatic diols such as an adduct of Bisphenol A and ethylene oxide, an adduct of Bisphenol A and propylene oxide, and the like. Among these, aromatic diols and alicyclic diols are preferable, and among these, aromatic diols are more preferable. It is possible to use 1 or 2 or more of these polyhydric alcohols. Among these, when an aromatic diol and an alicyclic diol are used together, it is preferable that 1,4-cyclohexane dimethanol be used as the alicyclic diol. It is particularly preferable that 1,4-cyclohexane dimethanol (A) and aromatic diol (B) be used at a molar ratio within a range of (A):(B)=35:65–65:35, and a range of 40:60–60:40 is further preferable. However, the polyester resin compounds described above only represent one example of the present invention; the invention is not limited thereto. Any polyester resin which can be formed into particles as easily as the above polyester resin and which performs excellently as a toner may be employed in the present invention.

In the case in which the synthetic resin used in electrophotographic toners having an ionic group is polyester resin, the carboxyl group positioned at the terminus can function as an anionic group; however, it is also possible to introduce an anionic group to the side chain of the polyester resin by cocondensing a monomer such as dimethylolpropionic acid, dimethyl sulfoisophthalic acid 5 sodium salt, or the like.

On the other hand, vinyl co-polymers, in which a vinyl monomer containing a cationic group is copolymerized with the polymerizable monomers described above containing no ionic groups, may be used as the synthetic resin containing cationic groups used in electrophotographic toners. Other examples include polyester resins which are co-condensed with diols containing tertiary amine groups represented by 2,2'-methyl amino diethanol and the like.

Examples of the vinyl monomer containing a cationic group include diethyl amino methacrylate, 4-vinyl pyridine, and the like.

The following explanation involves resins containing anionic groups.

Examples of other resins which may be used with synthetic resins containing ionic groups used in electrophotographic toners include styrene acrylic resins, epoxy resins, styrene butadiene resins, petroleum resins, and the like.

When the toner used in electrophotography obtained in the present invention is employed as a toner used in full color copiers or full color printers, it is preferable that the glass transition point of the synthetic resin be within a range of 55°–75° C., and a range of 60°–70° C. is further preferable. If the glass transition point is less than 50° C., the resistance to thermal coagulation (shelf life) of the toner is poor, and if this point is above 75° C., the fixing of the toner is poor.

No particular limits are set with respect to the softening point of the synthetic resin; however, a range of 70°–150° C. is preferable.

Furthermore, when the electrophotographic toner of the present invention is used in full color copiers and full color printers, it is preferable that the softening point of the synthetic resin be within a range of 70°–130° C., and a range of 90°–120° C. is further preferable. If the softening point of the synthetic resin is excess of 130° C., fixing is unsatisfactory, while when the softening of the synthetic resin is less than 70° C., the glass transition temperature is normally less than 50° C., and the resistance to thermal coagulation will be poor. Furthermore, phenomena such as the wrapping of paper around the fixing roll, and the offset phenomenon, are likely to occur. What is meant here by the softening point of the synthetic resin is a value measured by the ring and ball method.

No particular limitation is made with respect to the weight average molecular weight mesured by GPC (gel permeation chromatography) of the synthetic resin; however, a range of 2,000–200,000 is preferable. Within this range, in the case in which the toner is to be used as a full color toner, a range of 5,000–20,000 is more preferable. If the weight average molecular weight is less than 2,000, then the resin becomes too fragile for use as a toner binder resin, and the fixing to the OHP sheet deteriorates. On the other hand, when the weight average molecular weight is in excess of 200,000, poor fixing is caused.

The synthetic resin used in electrophotographic toner of the present invention may, where necessary, be present at less than 50 weight percent and may have another resin added thereto; however, in this case, it is preferable that the synthetic resin as a whole have an weight average molecular weight within a range of 2,000–200,000.

Fundamentally, all pigments are included in the coloring pigment of the present invention; however, examples of pigments which may be preferably used in the present invention include: Hanza Yellow 10G, Hanza Yellow G, Benzidene Yellow G, Benzidene Yellow GR, Permanent Orange, Lithol Fast Orange 3GR, Permanent Orange GTR, Vulcan Fast Orange GG, Permanent Red 4R, Fire Red, p-Chloro-o-Nitroaniline Red, Brilliant Fast Scarlet, Brilliant Carmine BS, Pyrazolone Red, Lithol Red, Lake Red C, Lake Red D, Brilliant Scarlet G, Permanent Red F5R, Brilliant Carmine 6B, Pigment Scarlet 3B, Rhodamine Lake, Alizarin Lake, Toluidine Maroon, Permanent Bordeaux F2R, Helio Bordeaux BL, Bordeaux 10B, BON Maroon Light, BON Maroon Medium, Thioindigo Maroon, Perylene Red, Permanent Red BL, the quinacridone pigment such as Permanent Pink E (FH), Phthalocyanine Blue, Fast Sky Blue, Indanthrene Blue RS, Pigment Green B, Naphthol Green B, Green Gold, Phthalocyanine Green, Naphthol Yellow S Lake, Quinoline Yellow Lake, Persian Orange, Peacock Blue Lake, Acid Green Lake, Para Red, Bordeaux 5B, Alkali Blue Toner Aniline Black, Carbon Black, and the like. However, the present invention is not necessarily limited to these pigments.

Among these colored pigments, Benzidene Yellows are preferable for use as yellow pigments, Brilliant Carmine 6B and quinacridone pigments are preferable for use as red pigments, while Phthalocyanine Blue is preferable for use as a blue pigment.

When the synthetic resin for use in electrophotographic toners of the present invention is used as a magnetic toner, it is possible to use triiron tetroxide, γ iron oxide, various ferrite powders, iron powder, or the like as the magnetic material.

In order to obtain the colored melted resin by heating and melting a kneaded product of a color pigment and the synthetic resin having an ionic group used in electrophotographic toner of the present invention, a mixture containing the synthetic resin described above and the color pigment described above is heated to a temperature which is greater than the softening temperature of the synthetic resin and below the heat decomposition temperature thereof using a pressurizing kneader, 3 heating rollers, a 2-axle extrusion kneader, or the like, and this is kneaded. The colored melted resin is obtained by melting and kneading a preprepared master batch and a dilution resin using a 1 axle or 2 axle extruder, and this is then transferred directly to the second process.

Furthermore, during this heating and melting, it is possible to mix in an electrostatic control agent which controls the electrostatic characteristics, and an offset prevention agent which increases the resistance to offsetting or the like.

Next, the aqueous medium containing a substance which neutralizes the ionic group of the present invention will be explained.

In general, this aqueous medium comprises water; it refers to a medium containing a substance which neutralizes ionic groups, so that for example, when the ionic groups are anionic groups, a basic substance is used as the substance which neutralizes the ionic groups.

What is meant by basic substances for neutralization is substances which neutralize acidic groups contained in the synthetic resin such as carboxyl groups, sulfonic acid groups, and phosphoric acid groups, produce hydrophilic groups, and thus make the resin self-dispersible in water.

In the case of the toner obtained by the phase inversion emulsification method using a solvent, it is necessary to neutralize the acidic groups of the synthetic resin in advance using a predetermined amount of basic substance prior to the dripping of the phase inversion water. However, as a result of the efforts of the present inventors, it has been determined that in the case of the toner for electrophotography of the present invention which does not employ a solvent, it is not necessary to neutralize the ionic groups of the synthetic resin in advance, and if the basic substance for neutralization is added to the aqueous medium, neutralization is sufficient. In this respect, the present invention represents a procedural simplification in comparison to the solvent method.

In the nonsolvent emulsification method of the present invention, both the melted synthetic resin having ionic groups and an aqueous medium containing a predetermined amount of an acidic substance or a basic substance for neutralization are simultaneously heated to a temperature above the softening point of the resin.

Since the proportion of aqueous medium with respect to the synthetic resin is sufficient to produce an aqueous system emulsification, at the instant in which the synthetic resin and the aqueous medium come into contact, the anionic groups of the synthetic resin are neutralized by the neutralizing substance, emulsification occurs, and an aqueous dispersion of the synthetic resin is formed.

Here, the amount of basic substance for neutralization which is used in the aqueous medium, with respect to the amount of anionic groups in the synthetic resin, is termed the neutralization ratio. In the case of the electrophotographic toner of the present invention, the neutralization ratio is appropriately within a range of 100–1,000% (10 times excess). The neutralization ratio is dependent on the synthetic resin components which are employed, and is also particularly dependent on the amount of anionic groups contained, so that the present invention is not restricted to these numerical values.

It is possible to employ the colored resin microparticles of the present invention in colored resin particles and powder paints other than toners, such as water based or oil based inks. In such a case, even if the neutralization ratio is less than 100%, even in the extreme case in which it is 0%, it is possible to produce the desired particles by the addition of a large amount of suspension stabilizer or surfactant.

When the colored resin microparticles of the present invention are used as a toner for electrophotography, the use of a large amount of suspension stabilizer or emulsing agent is not preferable.

Examples of basic substances which are used to neutralize the anionic groups in the present invention include alkaline metal hydroxides such as sodium hydroxide, potassium hydroxide, and lithium hydroxide, as well as the carbonates and acetates thereof, aqueous ammonia, and alkyl amines such as methyl amine, dimethyl amine, trimethyl amine, ethyl amine, diethyl amine, and triethyl amine, as well as alkanol amines such as diethanol amine and the like. Among these basic substances, the use of aqueous ammonia is especially preferable because the bulk of it is removed in the reverse neutralization process and the drying process described hereinbelow, and thus does not constitute an obstruction.

When the ionic group is a cationic group, examples of the substance used to neutralize the cationic group include inorganic acids such as hydrochloric acid, sulfuric acid, and nitric acid, as well as organic acids such as formic acid, acetic acid, and the like.

The aqueous medium described above is a high temperature aqueous medium obtained by heating, and where necessary, pressurization. The synthetic resin having an ionic group which is used in electrophotographic toners is melted using a heat exchanger or the like for heating, so that heating is conducted to a temperature of the softening point of the synthetic resin or greater. For this reason, pressure within a range of 1 $Kg/cm^2$–20 $Kg/cm^2$, depending of the softening point of the synthetic resin employed, is applied to the aqueous medium by a pressurizing mechanism which is provided in the process, and the temperature is appropriately regulated. When the softening point of the synthetic resin is low, there is no particular need for the use of a pressurizer mechanism; however, when the softening point is 100° C. or more, it is necessary to pressurize the aqueous medium so that it does not boil.

Next, a second process of the present invention will be explained.

In this second process, a mixture of the high temperature aqueous medium and the colored melted resin obtained in the first process of the resin described above is treated so that the melted colored resin is mechanically finely dispersed in the aqueous medium while maintaining the temperature so as to be the softening point of the synthetic resin or greater.

The apparatus used to finely disperse the melted color resin in the aqueous medium by physical means while maintaining the temperature at the softening point of the synthetic resin or higher is not particularly limited; however, the use of a high speed rotating type continuous emulsification disperser having a structure such that a ring shaped stator having slits and a ring shaped rotator having slits are provided coaxially with a slight gap therebetween so that the stator and the rotator are in mutual engagement is preferable.

In the high speed rotating type continuous emulsification disperser of the present invention, the melted colored resin and the high temperature and high pressure aqueous medium having a temperature of 100° C. or more are continuously introduced under pressure, rapid uniform mixing takes place under high temperature and pressure conditions such that the temperature is higher than the softening point of the synthetic resin and lower than the decomposition temperature of the synthetic resin, an emulsification is produced, dispersion occurs, and the structure is such that exhaust can be continuously conducted.

The high speed rotating type continuous emulsification disperser is capable of finely dispersing the melted synthetic resin in the aqueous medium by rotating the rotator at high speed. Since the temperature of this disperser is maintained at a temperature such as to keep the synthetic resin in a constantly melted state, it is necessary to maintain the temperature of the mixture at the softening point of the synthetic resin or higher, and for this reason, it is preferable that a jacket be provided on this disperser so as to maintain temperature. The optimum temperature of the synthetic resin differs depending on the particle diameter which is desired and the molecular weight of the resin; however, in the case in which the synthetic resin has an weight average molecular weight of approximately 10,000 and toner having an average particle diameter of 3–13 microns is to be produced from this linear polyester resin, a temperature of within a range of 150° C.–220° C. is optimal.

The temperature within the high speed rotating type continuous emulsification disperser is controlled so as to be at a constant temperature by means of a balance among the temperature of the melted colored resin which is supplied, the temperature of the aqueous medium which is supplied, the insulating effect of the jacket, and the heat generated by shearing forces within the apparatus.

Furthermore, the pressure within the high speed rotating type continuous emulsification disperser is determined by the vapor pressure of the aqueous medium at the temperature within the apparatus and the delivery pressure caused by the pump function of the rotator. Commonly, a method is preferable in which an automatic pressure control valve is provided after the cooling of the aqueous dispersion of the colored resin microparticles, the internal pressure is maintained at a constant level, and the aqueous dispersion is continually removed under atmospheric pressure.

In the high speed rotating type continuous emulsification apparatus, the mixture of the melted colored resin and the high temperature aqueous medium is supplied to high speed rotating type continuous emulsification disperser, this mixture passes through the rotator slit and the gap as a result of the high speed rotation of the rotator, flows from the center of the rotator in a centrifugal fashion, and while this mixture passes through the stator slit and the rotator slit, shearing forces are applied thereto, and while the mixture passes through the gap between the stator and the rotator, shearing stress is applied, and fine dispersion is caused. The same effects can be achieved if the slits in the stator and rotator are replaced by nozzles, so that it is permissible to replace one or the other of the slits, or both of the slits, of the stator and rotator with nozzles.

Hereinbelow, a high speed rotating type continuous emulsification disperser which is preferably employed in the mechanical fine dispersion of the present invention will be explained using the figures.

The stator 1 of the high speed rotating type emulsification disperser is affixed concentrically, and this center forms a liquid introduction port which communicates with a raw material introduction port and is open. 1 or 2 or more rows of ring shaped projections 3 which are concentric with the stator are provided so as to project in a number of rows from the circumferential surface of stator 1. The gaps between the projections form circumferential grooves 4, and a plurality of slits 5 are formed in the projections. The width of the slits is within a range of 0.6 mm–3.0 mm, and 12–72 slits are provided in each ring shaped projection, so that the shape is like the teeth of a comb. In order to decrease the diameter of is subjected to a shearing force as a result of the high speed rotation of the rotator, is subjected to shearing stresses while passing through the gap between the stator and the rotator and thereby, the melted colored resin is finely dispersed in the aqueous medium.

When rotator 7 is rotated at high speed,the melted colored resin and the high temperature and pressure aqueous medium supplied to the main liquid introduction port 2 of the high speed rotating type continuous emulsification disperser enter the slit of the innermost projections of the rotator, are delivered to the periphery of the innermost projections of the rotator by centrifugal force, press against the innermost projections of the stator, and enter the slits of the innermost projections of the stator. The mixture liquid which enters these slits is subjected to pressure from the mixture entering the innermost slits of the rotator as a result of centrifugal force, and is pushed into the centrifugal groove between the innermost projections and the second projections of the rotator. At this time, the mixture is subjected to shearing force by the innermost projections of the stator and the second projections of the rotator, and as the mixture passes through the gap between the stator and the rotator, it is subjected to shearing stress. When the mixture liquids flow together, further shearing forces are applied, this is pressed by following mixture liquids and enters the slits of the second projections of the stator, and by repeatedly undergoing the above, the the particles in the liquid which is supplied, it is preferable that the width of the slits of the projections become smaller towards the outside.

A drive axle 6 is attached to the center of the other inner wall within the high speed rotating type continuous emulsification disperser, and this is connected to a drive unit, and high speed rotation is thus conducted.

The rotator 7 of the high speed rotating type continuous emulsification disperser is affixed at the lead end of the drive unit so as to be coaxial with and parallel to the stator. The surface of the rotator which faces the stator is provided with 1 or 2 or more rows of multirowed projections 8 which are concentric with the rotator and are ring shaped. In the same manner as the stator, circumferential grooves 9 are formed by the gaps between the rotator projections, and a plurality of slits 10 are formed in these projections.

The stator 1 and rotator 7 are used in a state such that the projections 3 and circumferential grooves 4 of the stator and the projections 8 and circumferential grooves 10 of the rotator are inserted into one another so as to engage while maintaining a slight gap therebetween.

In the high speed rotating type continuous emulsification disperser used in the present invention, the mixture of melted color resin and high temperature, high pressure aqueous medium is supplied to the gap formed by this engagement, the mixture flows from the interior of the rotator in an outward direction, mixture is moved in order in the outward direction, and emulsification and dispersion are completed.

Figure 4:
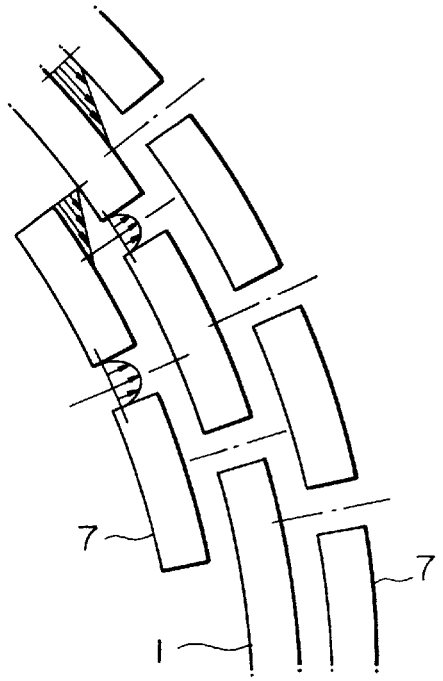
FIG. 4 shows the force applied to fluid flowing between the stator and the rotator as a result of the rotation of the rotator of the rotating type continuous emulsification disperser used in the present invention.

The relationship between the flow of this mixture and the shearing force and shearing stress is as shown in FIG. 4.

The speed of rotation of the rotator of the high speed rotating type continuous emulsification disperser is controlled by a drive motor connected to the drive axle. As the rotational frequency increases and the circumferential speed becomes large, a larger shearing force is imparted, and the diameter of the synthetic resin particles becomes smaller. When a rotator having a diameter of 10 cm is used, and a toner is produced having an average particle diameter within a range of 3–13 microns using a linear polyester resin in which the resin has an average molecular weight of approximately 10,000, a preferable rotational frequency is within a range of 3,000–10,000 rpm.

An example of a commercially available apparatus which can be used as the high speed rotating type continuous emulsification disperser of the present invention is the Cavitron (Eurotech Company).

The third process of the present invention will be explained.

The aqueous dispersion of colored resin microparticles obtained from the output port of the high speed rotating type continuous emulsification disperser are subjected to rapid cooling as quickly as possible to a temperature of the glass transition temperature of the synthetic resin or below, before the resin particles which have been produced collide with one another and an aggregate forms.

It is possible to use a commercially available heat exchanger as the apparatus for rapid cooling, and to conduct cooling by heat exchange with cooled water. No particular restriction is made with respect to the cooling rate; however, in order to avoid the development of an aggregate, this rate is preferably 10° C. per second or more.

After rapid cooling to a temperature in the vicinity of the glass transition temperature of the synthetic resin, the pressure is returned to atmospheric pressure by means of a pressure control valve, and thereby, a colored resin microparticle slurry is obtained.

Next, forth and fifth processes of the present invention will be explained.

The colored resin microparticles are separated from the aqueous dispersion of colored resin microparticles obtained in the third process, and these particles are dried.

Concretely, after the colored resin micro-particle slurry which was obtained has been filtered, in order to exchange neutralized basic functional groups for the original acidic groups, reverse neutralization is conducted using a 0.01 normal dilute hydrochloric acid solution and the like.

Next, after this resin slurry has been dehydrated and dried, classification may be conducted so as to achieve a desired diameter distribution in the same manner as in the pulverization method, and it is thus possible to obtain colored resin microparticles having a specified diameter. When the colored resin microparticles are to be used in a toner for electrophotography, this resin may be dry blended with a so called additive such as hydrophobic silica or the like to produce the toner for electrophotography. This classification process may also employ a wet classification using a wet cyclone.

An example of the flow from the first process to the fifth process described above will be explained using FIG. 5.

That is to say, melted colored resin is supplied from a tank 12 filled with melted colored resin produced by the method described above, via a resin pump 13, to the high speed rotating type continuous emulsification disperser 11, and at the same time a high temperature aqueous medium is obtained from an aqueous medium tank 14 filled with aqueous medium through a heat exchanger 15 for heating, and this high temperature aqueous medium is supplied to the high speed rotating type continuous emulsification disperser 11 via a pump 16. The melted colored resin and the high temperature aqueous medium are subjected to emulsification and dispersion within this emulsification disperser 11, and an aqueous dispersion of melted colored resin is obtained. This aqueous dispersion is immediately passed through a heat exchanger 17 for cooling, is cooled, and an aqueous dispersion of colored resin is obtained. The pressure of all the processes in this flow is regulated by a pressure regulating valve 18.

In the manufacturing method for electrophotographic toner of the present invention, by connecting a washing apparatus, a dehydrating apparatus, and a drying apparatus to the heat exchanger for cooling, it is possible to continuously conduct a series of processes from the melted colored resin and the high temperature aqueous medium through a high speed rotating type continuous emulsification disperser, to dehydration and drying. It is of course the case that after conducting everything up to the rapid cooling as a continuous process and obtaining a synthetic resin slurry, the synthetic resin may be washed in the tank, dehydrated, and dried.

In the present invention, as described above, a mixture of melted colored resin and a high temperature, high pressure aqueous medium is subjected to high shearing forces, shearing stress, and pressure fluctuations on a high frequency level in a high speed rotating type emulsification disperser, and a nonsolvent emulsification is achieved using powerful mixing and pulverization effects.

The synthetic resin produced in the emulsification process within the emulsification apparatus has a neutralized base structure and possesses self-dispersion stability, and if the period of time is short, the synthetic resin will not form an aggregate even if dispersion stabilizers or emulsifying agents are not employed, so that it is fundamentally not necessary to use dispersion stabilizers or emulsifying agents in the present invention.

Furthermore, although the elution of water soluble components (emulsification loss) is not completely absent, as described hereinbelow, it is greatly reduced in comparison with the "solvent method" described above, so that there is essentially no need to wash the synthetic resin particles, and they may simply be separated by filtration. With respect to this point, as well, the processes of the present invention are advantageous in that they are simple and thus the processes may be conducted in a continuous manner.

The factors controlling the average particle diameter of the colored resin microparticles which are produced are: (1) the amount of acidic groups contained in the synthetic resin, (2) the neutralization ratio of the acidic groups, (3) the rotational speed of the rotator of the emulsification disperser, and (4) the temperature of the synthetic resin and the aqueous medium. If the numerical values relating to these controlling factors are increased in size, the dispersability of the synthetic resin in water is increased, and the particle diameter of the synthetic resin microparticles is decreased.

As described above, the ionic groups of the synthetic resin are preferably present in an amount within a range of 1 . 50 mg equivalents per 100 g of resin; if these groups are present in an amount less than 1 mg equivalents per 100 g by weight, then no matter how the neutralization ratio is regulated, the average particle diameter of the toner obtained will be in excess of 12 microns, or the resin microparticles will aggregate during dispersion.

In such case, if a suspension stabilizer such as polyvinyl alcohol or the like is added to the aqueous medium, then the aggregation of the resin microparticles can be prevented; however, in the case of the toners for electrophotography of the present invention, there is a problem in that the suspension stabilizer adhering to the toner particles must be completely removed by washing.

On the other hand, if the ionic groups of the resin are present in an amount in excess of 50 mg equivalents per 100 g of resin, then no matter how the neutralization ratio is regulated, the particle diameter will be less than 1 micron, and this particle diameter is too small for use in powder toners which are presently widely used in electrophotographic technology, and is thus not preferable.

However, the present invention does not deny the fact that resin particles of less than 1 micron may come to be used in the future as toners.

As described above, the aqueous medium used in the present invention primarily comprises water, and represents basic substances added to water in order to neutralize ionic groups of the synthetic resin; it is not necessary to add suspension stabilizers or emulsifying agents. With respect to the quality of toners obtained, suspension stabilizers or emulsifying agents which remained deposited on resin particles greatly adversely effect the electrostatic characteristics of toners, so that it was absolutely necessary to conduct washing in order to remove these substances; however, perfect washing and removal was not possible. The present invention does not prohibit the concomitant use of suspension stabilizers or emulsifying agents.

Examples of suspension stabilizers include water soluble polymer dispersion stabilizers such as polyvinyl alcohol and hydroxyethyl cellulose, which are frequently used in the suspension polymerization of styrene and the like, or inorganic dispersion stabilizers which are resistant to solution in water, such as calcium phosphate; an appropriate substance may be selected from among these.

Next, the features of the electrophotographic toner produced in the present invention will be explained.

The present inventors have discovered that, when a toner containing polyester resin is produced by means of the manufacturing method of the present invention, acid component monomers such as terephthalic acid or the like which remain in the polyester resin during emulsification are eluted and washed away in the aqueous medium. In particular, if a great excess of basic substances are contained in the aqueous medium, a considerable amount of the acidic component monomers are removed.

This phenomenon is not seen in toners produced by the conventional pulverization method, and is extremely advantageous from the point of view of worker hygiene. As described above, a number of problems have come to light in recent years regarding safety and hygiene related to toners. The monomers remaining in the toner and, in particular, the styrene monomers remaining in styrene acrylic toners, have caused great concern, and consideration has been given to the reduction of the amount remaining at the stage of resin synthesis.

The problem of how to reduce the amount of aromatic carboxylic acids such as terephthalic acid monomers or the like remaining was also difficult in the case of polyester system toners. Styrene monomers are comparatively easy to remove under strong vacuums; however, the removal of acid component monomers such as terephthalic acid or the like was impossible under a vacuum.

On the basis of the insights of the present inventors, it is also become possible to provide a novel toner having an extremely low level of acid component monomers such as terephthalic acid or the like remaining in the polyester resin produced by the present method.

That to say, in comparison with the standard synthesis of polyester resins for toners, in which residual acid component monomers were present at a level of 300–1000 ppm, in the toners obtained by the non-solvent emulsification method of the present invention, the residual amount of acid component monomers is 200 ppm or less, and in certain cases, these monomers are present at a level of 150 ppm or less, which is the lower limit for detection by means of gas chromatography.

Commonly, a phenomenon is known in which the toner is subjected to shearing force for long period of time with a carrier in a developing box, and in the course of being mixed, the monomers or low molecular weight molecules remaining in the toner are selectively deposited on the surface of the carrier and contaminate those surfaces. This may be evaluated by a forced agitation test (an endurance simulation test in which developing is not conducted) in which the developing box of a commercially available copier is filled with a developer and this is driven by external motors for a long period of time. When the carrier contamination proceeds, the electrical resistance of the carrier increases, and the electrostatic charge also changes.

The toner obtained in the present invention has an extremely low residual amount of acid component monomers, so that the electrical resistance and electrostatic charge are extremely stable even in endurance tests of 200 hours; thus, the endurance is superior.

The colored resin microparticles obtained in the manufacturing method of the present invention may be used in a wide variety of fields other than the electrophotographic toners described above; for example, they may be used as color resin microparticles used in water based or oil based inks, in powdered paints, and in powder slurry paints or the like.

With respect to water based inks, use is possible as colored resin microparticles containing pigment which are used in applications such as ink jet recording, writing apparatuses, and the like. With respect to oil based inks, use is possible as colored microparticles comprising resin and pigments which can easily be turned into ink. In the field of powdered paint and powder slurry paint, it is in particular possible to provide the small diameter (0.1–10 microns) powder or slurry paints conventionally available.

Hereinbelow, examples of the present invention are shown; however, the present invention is in no respect limited to these examples. Furthermore, the parts and percent referred to in the examples are based on a weight standard.

(Example 1)

576 parts (corresponding to 4 moles) of cyclohexane dimethanol, 1950 parts (corresponding to 6 moles) of Bisphenol A ethylene oxide 2.2 mole adduct, 1494 parts (corresponding to 9 moles) of terephthalic acid, and 4 parts of dibutyl stannous oxide were placed in a flask having an agitator, a thermometer, a $N_2$ gas introduction pipe, and a fractionating column, agitation and heating were conducted under a $N_2$ gas flow and a dehydration polymerization reaction was conducted at 240° C. At this time, care was taken that the raw material monomers not distill off, and in the case of such distillation, the distilled portion was replenished and regulation conducted so that resin composition was in accordance with the composition of the ingredients placed in the flask. After the reaction was completed so that the acid number became 8 mg·KOH/g (the total amount of acid groups contained corresponded to 14.3 mg equivalents per 100 g of resin) this was extracted. The softening point of the polyester resin as measured by the ring and ball method was 110° C.

A master batch was produced using two-roller mill with 70 parts of this resin and 30 parts of phthalocyanine pigment (Pigment Blue 15–3), and this was diluted to 1:10 using the same resin and a 2 axle continuous kneading apparatus. This was placed in the kneaded melted product tank of FIG. 5, heating was conducted to 200° C., and this was fed Cavitron CD1010 at a rate of 100 g/minute.

Figure 5:
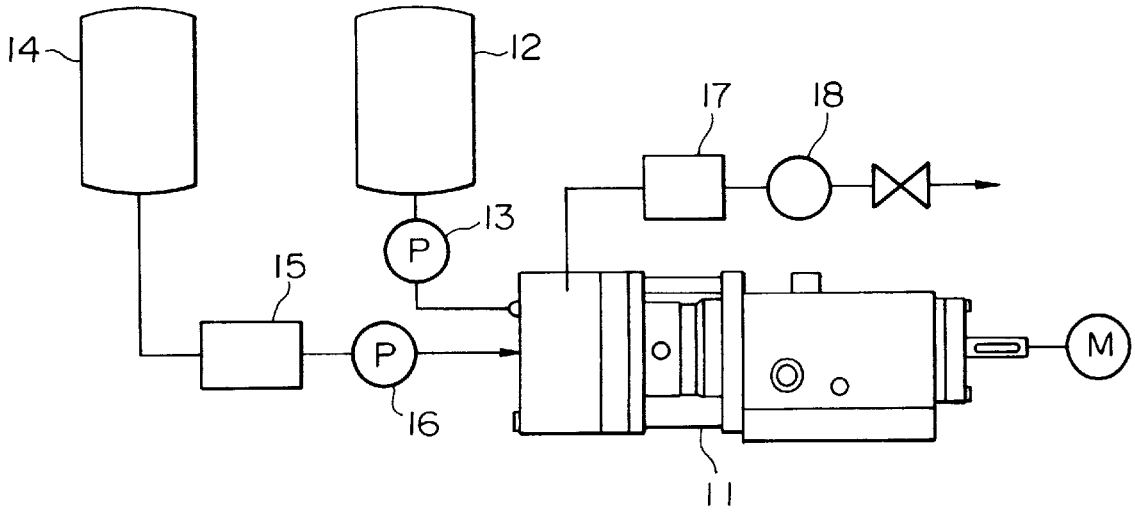
FIG. 5 is an explanatory diagram of the manufacturing method for toner used in electrophotography in accordance with the present invention.

Dilute aqueous ammonia having a concentration of 0.097 weight percent, comprising sample aqueous ammonia diluted with ion exchanged water, was placed in the aqueous medium tank of FIG. 5, and while heating this to a temperature of 150° C. using a heat exchanger, this was delivered to the Cavitron at a rate of 1 liter/minute (a neutralization ratio of 400%). The rotational speed of the rotator was 8,000 rpm, the pressure was 7 $Kg/cm^2$, and the slurry that was produced was cooled from 165° C. to 65° C. within 10 seconds, and was extracted.

After the toner particles have been separated by filtration, dilute hydrochloric acid is poured over them, and revers neutralization is conducted, and the neutralized basic structures present on the surface of the particles are exchanged for acidic ones, water washing is conducted, drying is conducted, and the toner is thus obtained.

The toner particle yield was 99% (the emulsification loss was 1% or less).

After the toner was classified using a classifier, this was dry blended with 0.2% hydrophobic silica (R-972 produced by Nippon Aerosil Company), and an essentially spherical blue colored toner having an average particle diameter of 6.8 microns was obtained.

5 parts of this toner and 95 parts of a ferrite carrier (the electrical resistance of which was $10^7$ ohm·cm) having an average particle diameter of 80 microns were mixed for 1 hour in 1 liter of plastic bottle at a rotational speed of 100 rpm to prepare a developer. The electrostatic charge was measured using a blow off powder electrostatic charge measuring apparatus TB-200, and was found to be −30 $\mu$C/g. A commercially available copier using a selenium photosensitive drum was modified by the removal of the heat roller fixing apparatus, and this was used as a developing test apparatus and developing tests were conducted; and as a result, a sharp blue image showing no fogging or bleeding was obtained. (The fixing to the paper was conducted in a thermostatic dessicator at a temperature of 150° C.)

The amount of residual terephthalic acid in the toner was measured by gas chromatography and was found to be below the lower detection limit (150 ppm).

The developing box of a commercially available copier was filled with the developer described above, and a forced agitation test (an endurance simulation test in which developing was not conducted) was conducted for a period of 200 hours driven by an external motor. When the electrostatic charge was measured after 200 hours, it was found to −30 $\mu$C/g. After the toner was separated by blow off, the electric resistance of the carrier was measured, and was found to be $10^7$ ohms·cm. This toner was judged to be a toner having extremely good endurance which was unlikely to be affected by carrier contamination.

(Comparative Example 1)

A "solvent method" corresponding to example 1 above is shown as a comparative example.

576 parts (corresponding to 4 moles) of cyclohexane dimethanol, 1950 parts (corresponding to 6 moles) of Bisphenol A ethylene oxide 2.2 mole adduct, 1494 parts (corresponding to 9 moles) of terephthalic acid, and 4 parts of dibutyl stannous oxide were placed in a flask provided with an agitator, a thermometer, a $N_2$ gas introduction pipe, and a fractionating column, and this was agitated and heated in the presence of a $N_2$ gas flow, and dehydration polymerization was conducted at a temperature of 240° C. Care was taken that the raw material monomers were not distilled off at this time, and in the case of such distillation, the distilled portion was replenished, so that the composition of the resin which was obtained was regulated so as to be the same as that as the ingredients provided. The reaction was continued to the point at which the acid number became 8 mg·KOH/g (corresponding to the total amount of acid groups contained of 14.3 mg equivalents per 100 g of resin), the $N_2$ was stopped, and cooling was conducted to 160° C. while agitating. The fractionating column was replaced with a Dimroth condenser, and while further agitating and cooling, 5551 parts of THF were slowly added to the top of the Dimroth condenser, and when this had been cooled to 20° C., 25.2 parts of 25% aqueous ammonia was added and a neutralization reaction was carried out, this was then further cooled to room temperature, and a THF solution (40% resin component) of polyester having a neutralized basic structure (neutralization ratio of 70%) was obtained. This resin solution was completely dried, and the softening point of the resin as measured by the ring and ball method was 110° C.

3 parts of phthalocyanine pigment [KET BLUE 104(C.I. Pigment Blue 15–3) produced by Dai-Nippon Ink and Chemicals Incorporated] was added to 242.5 parts of the resin solution described above, and this was kneaded for a period of 24 hours in a ball mill. After the THF lost in the process of kneading was replenished, 100 parts of this mixture were placed in a 300 ml flask, and 100 parts of ion exchanged water were dripped into the flask for a period of 1 hour while agitating at 600 rpm using a turbine blade. After the removal of the THF by vacuum distillation while maintaining the contents of the flask at a temperature of 40° C., the toner particles were separated by filtration. After the wet cake was washed with water, dilute hydrochloric acid was poured over this, reverse neutralization was conducted, and after the neutralized basic structure present on the surface of the particles was exchanged for an acidic structure, this was thoroughly washed, and dried to produce the toner.

The toner yield was 90%. That is to say, 100% was eluted in the aqueous medium during particle generation. In other words, the emulsification loss in the solvent method was 10%, and in comparison with the non-solvent method described above, which showed an emulsification loss of less than 1%, this was extremely large, and the waste water treatment was difficult.

(Comparative Example 2)

The mixture obtained in Example 1 was pulverized in a jet mill, classified, and 0.2% of hydrophobic silica (R-972 produced by Nippon Aerosil Company) was dry blended with this to produce a blue toner having an average particle diameter of 6.8 microns. The amount of residual terephthalic acid present in the toner was analyzed by gas chromatography, and was found to be 320±40 ppm.

5 parts of this toner were mixed with 95 parts of a ferrite carrier (having an electrical resistance of $10^7$ ohms cm) having an average particle diameter of 80 microns, for a period of 1 hour in 1 liter of plastic bottle and at a rotational speed of 100 rpm, and developer was thus prepared. When the electrostatic charge was measured using a blow off powder electrostatic charge measuring apparatus TB-200, it was found to be −32 $\mu$C/g.

The developing box of a commercially available copier was filled with this developer, and a forced agitation test (an endurance simulation test in which developing was not conducted) was conducted for a period of 200 hours driven by an external motor. The electrostatic charge was measured after 200 hours and was found to be −39 $\mu$C/g. After the toner had been separated by blow off, the electrical resistance of the carrier was measured and found to have risen to $10^8$ ohm cm.

(Example 2)

A styrene/2-ethylhexylacrylate/methacrylic acid copolymer (wherein the monomer weight ratio was 85/10/5, the amount of acidic groups was 58 mg equivalents per 100 g, and the softening point as measured by the ring and ball method was 125° C.) was used in place of the polyester resin of Example 1.92 parts of this copolymer and 8 parts of the carbon black (Elftexs 8 produced by Cabot Incorporated) were added together and this was kneaded in a pressurized kneader. The kneaded chip was heated to a temperature of 190° C. using a single axle extruder and was supplied to a Cavitron CD 1010 at a rate of 100 g per minute. With respect to the aqueous medium, a dilute aqueous ammonia having a concentration of 0.4 weight percent was supplied to the Cavitron at a rate of 1 liter per minute while heating to a temperature of 160° C. using a heat exchanger (a neutralization ratio of 400%). The rotational speed of the rotator was 9,000 rpm, the pressure was 7 kg/cm$^2$, and the slurry produced was cooled from 165° C. to 65° C. within a period of 10 seconds and was extracted.

After the toner particles had been separated by filtration, dilute hydrochloric acid was poured over them to conduct reverse neutralization, and the neutralized basic structures present on the surface of the particles were exchanged for acidic ones, this was washed with water, and dried to produce the toner.

The toner yield was 99% (the emulsification loss was less than 1%). After the toner particles had been classified in a classifier, this was dry blended with 0.2% of hydrophobic silica (R-972 produced by Nippon Aerosil Company), and an essentially spherical black toner having an average particle diameter of 7.5 microns was obtained. 5 parts of this toner and 95 parts of ferrite carrier having an average particle diameter of 80 microns were mixed in 1 liter of plastic bottle at a rotational speed of 100 rpm and for a period of 1 hour, and a developer was thus prepared. When the electrostatic charge was measured using a blow off powder electrostatic charge measuring apparatus TB200, it was found to be −25 $\mu$C/g. A commercially available copier using a selenium photosensitive drum was modified by the removal of the heat roller fixing apparatus, and using this a a developing test apparatus, a development test was conducted, and as a result, a sharp black image showing no fogging or bleeding was obtained.

(Example 3)

60 parts of the polyester resin employed in Example 1 and 40 parts of the styrene/2-ethylhexylacrylate/methacrylic acid copolymer employed in Example 2 (wherein the monomer weight ratio was 85/10/5, the amount of acidic groups contained was 58 mg equivalents per 100 g, and the softening point as measured by the ring and ball method was 125° C.) were mixed, and this was used. A master batch was produced from 70 parts of this resin mixture and 30 parts of red pigment brilliant carmine 6B (C.I. Pigment Red 57–1) using two-roller mill, and this was diluted to 1:10 with the same resin using a 2 axle continuous kneading apparatus. The kneaded chip was heated to a temperature of 190° C. using a single axle extruder, and this was supplied to the Cavitron CD 1010 at a rate of 100 g per minute. With respect to the aqueous medium, a dilute aqueous ammonia having a concentration of 0.22 weight percent was supplied to the Cavitron at a rate of 1 liter per minute while heating to a temperature of 160° C. using a heat exchanger (a neutralization ratio of 400%).

The rotational speed of the rotator was 8,000 rpm, and the pressure was 7 Kg/cm$^2$, and the slurry produced was cooled from 165° C. to 65° C. within a period of 10 seconds and this was extracted.

After the toner particles had been removed by filtration, dilute hydrochloric acid was poured over these to conduct reverse neutralization, and the neutralized basic structures present on the surface of the particle were exchanged for acidic ones, and this was then washed and dried to produce the toner.

The toner particle yield was 99% (the emulsification loss was less than 1%). After the toner particles had been classified using a classifier, they were dry blended with 0.2% of hydrophobic silica (R-972 produced by Nippon Aerosil Company) and an essentially spherical red color toner having an average particle diameter of 6.5 microns was obtained. 5 parts of this toner and 95 parts of ferrite carrier having an average particle diameter of 80 microns were mixed in 1 liter of plastic bottle for a period of 1 hour and at a rotational speed of 100 rpm, and a developer was prepared. When the electrostatic charge was measured using a blow off powder electrostatic charge measuring apparatus TB-200, this was found to be −29 $\mu$C/g. A commercially available copier using a selenium photo sensitive drum was modified by the removal of the heat roller fixing apparatus, this was used as a developing test apparatus, and a developing test was conducted, and as a result, a sharp red image exhibiting no fogging or bleeding was obtained.

The amount of residual terephthalic acid present in the toner was measured using gas chromatography, and this was found to be below the lower level of detection (150 ppm).

(Reference Example)

The polyester resin used in Example 1 was subjected to chain lengthening with hexamethylene diisocyanate (HMDI), and polyurethane was synthesized. This polyurethane (having an amount of acid groups contained of 3.5 mg equivalents per 100 g, and a softening point as measured by the ring and ball method of 140° C.) was heated to a temperature of 190° C. using a single axle extruder, and this was provided to the Cavitron CD1010 at a rate of 100 g per minute. With respect to the aqueous medium, a 0.1% solution of polyvinyl alcohol PVA-420 (produced by Kuraray Incorporated) was prepared, and this was supplied to the Cavitron at a rate of 1 liter per minute while heating to a temperature of 160° C. using a heat exchanger (a neutralization ratio of 0%).

The rotational speed of the rotator was 7,000 rpm, and the pressure was 7 Kg/cm$^2$, and the slurry produced was cooled from a temperature of 165° C. to 65° C. within 10 seconds and this was extracted, filtered, and dried. The average particle diameter of the resin particles was 40 microns, and the yield was 99% (an emulsification loss of less than 1%). These resin particles are useful as powdered paint, and may also be employed as filler material for building resins and paint resins.

What is claimed is:

1. A manufacturing method for a toner used in electrophotography, the method comprising the steps of:

(1) forming a mixture of a colored melted resin (a) and an aqueous medium (b), wherein the colored melted resin (a) is prepared by heating and melting a kneaded material containing a synthetic resin having an ionic group for use in a toner for electrophotography and a coloring pigment, and the aqueous medium (b) has dissolved therein a substance capable of neutralizing the ionic group, and is held at a temperature not lower than the softening point of the synthetic resin by way of heating with application of pressure where necessary;

(2) dispersing the colored melted resin (a) in the aqueous medium (b) by mechanical means while maintaining said mixture of the colored melted resin (a) and the aqueous medium (b) at a temperature not lower than the softening point of the synthetic resin;

(3) producing an aqueous suspension of colored resin microparticles by means of sudden cooling;

(4) separating the colored resin microparticles from the suspension; and (5) drying the separated colored resin microparticles.

2. A manufacturing method for a toner used in electrophotography in accordance with claim 1, wherein the amount of the ionic group is within a range of 1–50 mg equivalents per 100 g of the synthetic resin for the electrophotographic toner.

3. A manufacturing method for a toner used in electrophotography in accordance with claim 1, wherein the synthetic resin for the electrophotographic toner having an ionic group is selected from the group consisting of a polyester resin, a vinyl co-polymer, and a combination thereof, the softening point of the synthetic resin being within a range of 70°–150° C.

4. A manufacturing method for a toner used in electrophotography in accordance with claim 1, wherein the synthetic resin for the electrophotographic toner having an ionic group contains a polyester resin at least 50 percent by weight.

5. A manufacturing method for a toner used in electrophotography in accordance with claim 1, wherein the ionic group is an anioic group, and the substance capable of neutralizing the ionic group is an alkaline substance.

6. A manufacturing method for a toner used in electrophotography in accordance with claim 1, wherein the dispersion by mechanical means is conducted using a high speed rotating type continuous emulsification disperser which is provided with a ring shaped stator having slits, and a ring shaped rotator having slits, which are arranged coaxially with a slight gap therebetween so that the stator and the rotator engage with one another.

7. A manufacturing method for a toner used in electrophotography in accordance with claim 6, wherein the dispersion by mechanical means is conducted by:

supplying a mixture of the melted colored resin (a) and the aqueous medium (b) possessing the raised temperature to the high speed rotating type continuous emulsification disperser; and allowing the mixture of the melted colored resin (a) and the aqueous medium (b) to move from the center of the rotator in a centrifugal fashion, passing through the slits and the gap of the stator and the rotator by the high speed rotation of the rotator, so that the mixture is subjected to shearing forces when passing through the slits of the stator and the slits of the rotator, and so that the mixture is subjected to shearing stress when passing through the gap between the stator and the rotator; thereby dispersing the colored melted resin (a) in the aqueous medium (b).

8. A manufacturing method for a toner used in electrophotography in accordance with claim 1, wherein steps (1) to (3) are conducted in a continuous process.

9. An electrophotographic toner obtained by the manufacturing method in accordance with claim 1, wherein said electrophotographic toner comprises polyester resin.

* * * * *